US009612006B2

(12) United States Patent
Powell et al.

(10) Patent No.: US 9,612,006 B2
(45) Date of Patent: Apr. 4, 2017

(54) TABLE WITH INTEGRATED LIGHTING

(71) Applicant: Assa Group, Inc., Lowell, MI (US)

(72) Inventors: David J. Powell, Lowell, MI (US); Jeffrey S. Wilcox, Grand Rapids, MI (US); Dante M. Zeppa, Grand Rapids, MI (US); Gary R. Ludwig, Holland, MI (US)

(73) Assignee: Assa Group, Inc., Lowell, MI (US)

( * ) Notice: Subject to any disclaimer, the term of this patent is extended or adjusted under 35 U.S.C. 154(b) by 0 days.

(21) Appl. No.: 15/181,779

(22) Filed: Jun. 14, 2016

(65) Prior Publication Data

US 2016/0363310 A1 Dec. 15, 2016

Related U.S. Application Data

(60) Provisional application No. 62/175,353, filed on Jun. 14, 2015.

(51) Int. Cl.

| | |
|---|---|
| ***A47B 13/00*** | (2006.01) |
| ***F21V 33/00*** | (2006.01) |
| ***A47B 13/12*** | (2006.01) |
| *F21Y 115/10* | (2016.01) |

(52) U.S. Cl.

CPC ..... *F21V 33/0012* (2013.01); *A47B 13/12* (2013.01); *F21Y 2115/10* (2016.08)

(58) Field of Classification Search

CPC ..... A47B 13/12; A47B 2013/125; A47B 2220/0077; F21V 33/00; F21V 33/0012; F21V 33/0024; F21V 3/0445; F21V 2131/301

See application file for complete search history.

(56) References Cited

U.S. PATENT DOCUMENTS

| | | | | |
|---|---|---|---|---|
| 4,843,524 | A * | 6/1989 | Krent | A47B 13/12 362/127 |
| 5,816,171 | A * | 10/1998 | Fitts, Jr. | A47B 13/12 108/20 |
| 5,911,496 | A * | 6/1999 | Hojnacki | A47B 3/12 108/23 |
| 2002/0159246 | A1* | 10/2002 | Murasko | A47B 13/12 362/84 |
| 2008/0291659 | A1* | 11/2008 | Huang | A47B 13/12 362/84 |

(Continued)

*Primary Examiner* — Daniel Rohrhoff

(74) *Attorney, Agent, or Firm* — Oppenhuizen Law PLC; David L. Oppenhuizen

(57) ABSTRACT

A table having integrated lighting includes a table top having an upper surface, a lower surface, and a side edge. At least one light-diffusing insert is mounted along at least a portion of the side edge. There is also provided at least one lighting element mounted within the table top to illuminate the light-diffusing insert. The light-diffusing insert and the lighting element are housed within a horizontally-extending recessed channel along the side edge of the table. The table also includes at least one base support mounted beneath the table top. The base support has at least one open channel extending the length of the base support through which an electrical wire extends upwardly to the table top. The electrical wire is connected through the table top to the lighting element to provide electrical power to the lighting element.

18 Claims, 6 Drawing Sheets

(56) References Cited

U.S. PATENT DOCUMENTS

| | | | | |
|---|---|---|---|---|
| 2009/0161373 | A1* | 6/2009 | Teng | A47B 25/00 362/382 |
| 2009/0200966 | A1* | 8/2009 | Whitehouse | A47B 97/00 315/309 |
| 2012/0227635 | A1* | 9/2012 | Stobart | A47B 13/12 108/23 |
| 2015/0033606 | A1* | 2/2015 | Dinlocker | A47G 1/14 40/727 |
| 2015/0300627 | A1* | 10/2015 | Wang | F21V 33/0012 108/23 |

* cited by examiner

TABLE WITH INTEGRATED LIGHTING

CROSS REFERENCE TO RELATED APPLICATION

This application claims the benefit of U.S. Provisional Application 62/175,353, which was filed on Jun. 14, 2015, the disclosure of which is hereby incorporated by reference.

BACKGROUND OF THE INVENTION

1. Field of the Invention

The present invention pertains to the field of office furniture, and more specifically to a table which includes integrated lighting elements for functional and/or aesthetic purposes. More particularly, the table provides for integrated lighting along various surfaces and edges, and the table has a construction which conceals the necessary wiring and power components for the lighting.

2. Description of the Prior Art

Tables solve a variety of needs including meeting spaces, collaboration areas, training areas, cafeterias, office work spaces, teaching areas, and more. Tables come in a variety of sizes, finishes, colors, edge profiles, aesthetics and materials. In some instances tables may be provided with light sources that can be used to illuminate materials and articles placed on a surface of a table to facilitate the illumination of an object for study or work and for improving visual study and reading efficiency and the like. Such lamp type reading or examination lighting, however, is not generally built into a table such that wiring and other components of the lighting system are out of sight.

In view of the foregoing, it would be beneficial to provide tables, and particularly conference and like workspace tables, with lighting systems that can include table top or edge illumination features and base illumination features wherein all wiring, electrical connections, and lighting elements are integrated into the tables to enhance the aesthetic appearance of the tables when in use.

Thus, there remains a need for a table having integrated lighting elements which conceal the wiring, electrical components, and lighting elements to provide an aesthetically pleasing and clean appearance.

The present invention, as is detailed hereinbelow, seeks to fill this need by providing a table having integrated lighting and having a construction that conceals the necessary wiring and power components for the lighting.

SUMMARY OF THE INVENTION

The present invention is directed to tables for use by a plurality of people, such as conference tables or work station tables that include embedded wiring, connections and lighted aesthetic elements that can create unique design appearances and aesthetics. The tables of the invention may include fully integrated/embedded side lighting, surface lighting, and base lighting. By way of example, the lighted elements may include lighting elements mounted within table edges for decorative purposes or to provide side or base lighting for additional safety and visibility around or below a table surface. Such lighting elements may also be used to illuminate portions of a table top or a base portion of the table either for aesthetics or safety purposes.

In keeping with the invention, a table may have a work surface with horizontally-extending edge lighting that extends around a perimeter of the table top to provide a clean, crisp line of ambient lighting. The light can be dimmable and can be displayed in a variety of colors. The work surface can be in a variety of shapes, any of which are standard to the furniture industry or customized to an end user's specifications. The work surface can be supported with stand-alone table bases, a systems furniture product, linked benching, part of a furniture storage piece, or a conference table. Optionally, the table can include vertically-extending edge lighting provided along the side of the base or legs of the table.

In each of the embodiments of the invention, all wiring, lighting elements and electrical connections, with the exception of input electrical cables or cords, will be confined or integrated within the table so that the illuminated table is not cluttered with unsightly wires or cords. Only light emanating from the light sources within the table will be viewable (and not the lighting elements or wiring).

As discussed, the present invention provides a table having integrated lighting which generally comprises: a table top having an upper surface, a lower surface, and a side edge; at least one light-diffusing insert mounted along at least a portion of the side edge; and at least one lighting element mounted within the table top so as to illuminate the at least one light-diffusing insert.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

Figure 1:
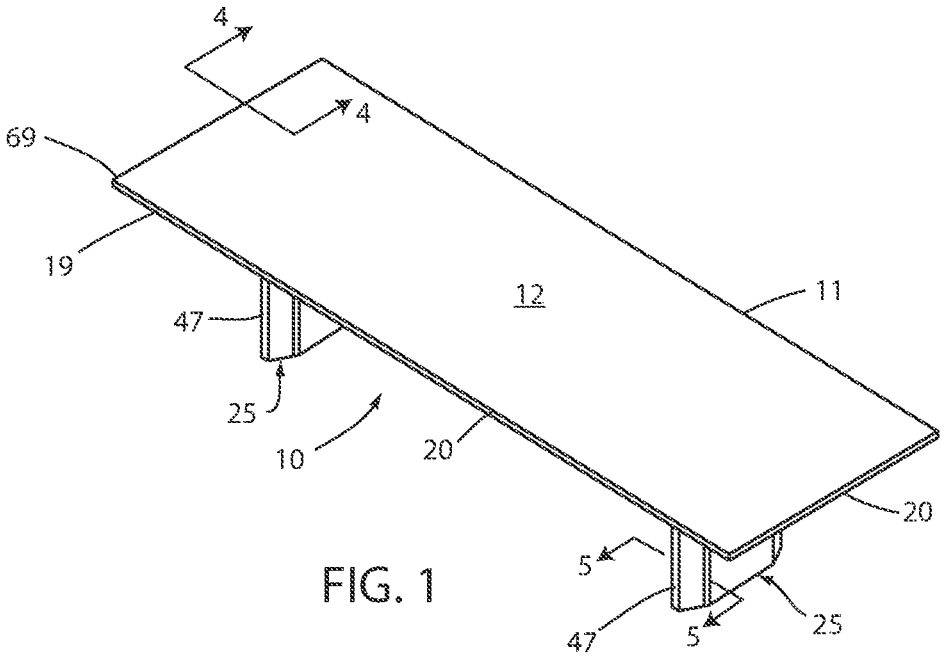
FIG. 1 is a top perspective view of a first embodiment of a conference table in accordance with the invention and showing edge lighting for the table top and vertical lighting for the table legs.
Figure 3:
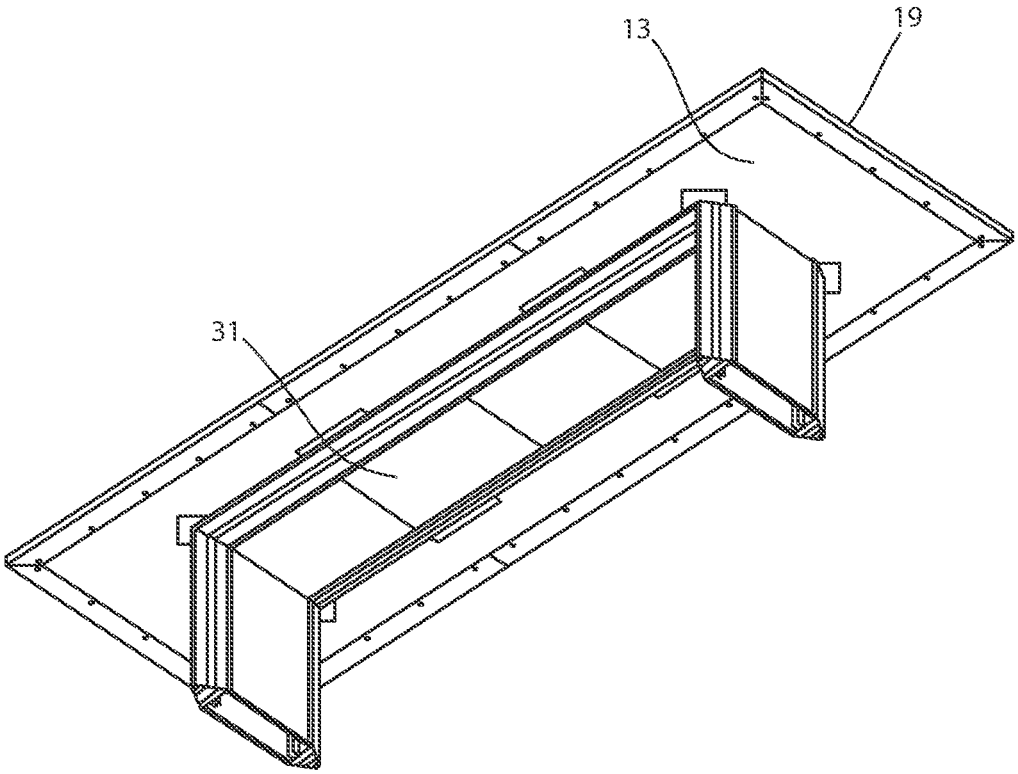
FIG. 3 is a bottom perspective view of the conference table shown in FIG. 1 showing the bottom surface of the table top, the base supports, and the wire management panel.

In accordance with the present invention and as shown generally in FIGS. 1 and 3, there is provided a table 10 having integrated lighting comprising: a table top 11 having an upper surface 12, a lower surface 13, and a side edge 19; at least one light-diffusing insert 20 mounted along at least a portion of the side edge 19; and at least one lighting element 22 mounted within the table top 11 so as to illuminate the at least one light-diffusing insert 20.

Figure 2:
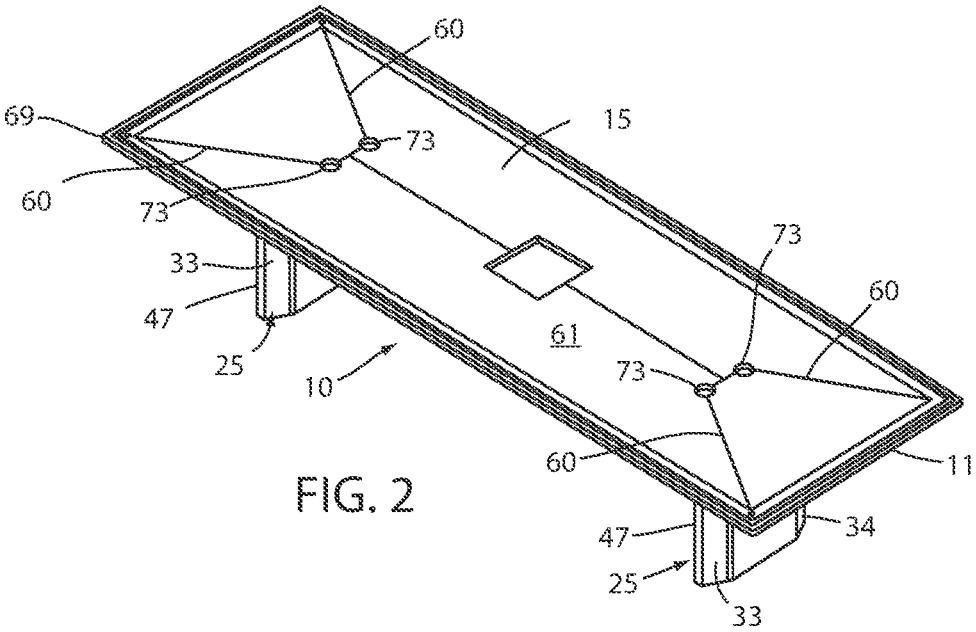
FIG. 2 is a view similar to FIG. 1 with an upper surface portion of the table top removed in order to show openings and channeling for electrical wires inside the table top.
Figure 4:
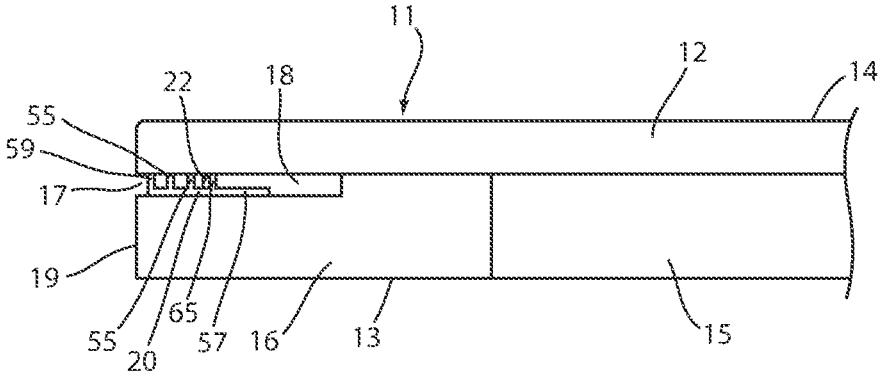
FIG. 4 is a cross section taken along line 4-4 of the table top of FIG. 1 showing upper and lower top portions, a recessed channel, light-diffusion edging material and an LED lighting strip.

As shown in FIG. 4, the conference table 10 has a table top 11 that defines an upper work surface 12. Unlike conventional table tops, the table top 11 is constructed having an upper portion or layer 14 that includes the work surface 12, and a lower portion or layer 15 that is surrounded by a lower edge portion 16. This is also shown in FIG. 2 in which the upper portion 14 of the table top 11 has been removed to show details of the lower portion 15. A unique feature of the tables of the invention is that the tables may include fully integrated/embedded table top edge lighting, base supports lighting, or table top work surface lighting with all of the electronics mounted within the table, including the wiring, connectors, electrical components, and light elements, such as light emitting diodes (or LEDs).

With reference to FIGS. 2 and 4, the table tops of the invention are provided with edge lighting or illumination. In FIG. 4, a cross section of the table top is shown which includes the upper portion 14 of the table top 11 and the lower edge portion 16. The lower edge portion 16 is notched at 17 creating a horizontally-extending open recessed channel 18 between the upper portion 14 and the lower edge portion 16 of the table top 11. The light-diffusing insert 20 and the lighting element 22 are housing within the channel 18.

The light-diffusing insert 20 may be formed of a plastic material, such as an acrylic or a polycarbonate, or of a glass material. Preferably the light-diffusing insert 20 is semi-transparent, or translucent, such that it transmits light but causes sufficient diffusion to prevent perception of distinct images behind the insert 20. Accordingly, the light-diffusing insert 20 is preferably illuminated along its entire length in a consistent glow of illumination, but that the lighting elements 22 are not actually visible from outside of the table 10. Optionally, parts of the insert 20, such as the outermost wall, may be formed from a first material (e.g., glass or acrylic) while other parts of the insert 20, such as inner walls, may be formed from a second material (e.g., a plastic). As shown, the insert 20 does not fill the entire notched area as space remains open for receiving the lighting elements 22, such as LEDs, electrical wiring, and possibly heat sink materials.

Figure 9:
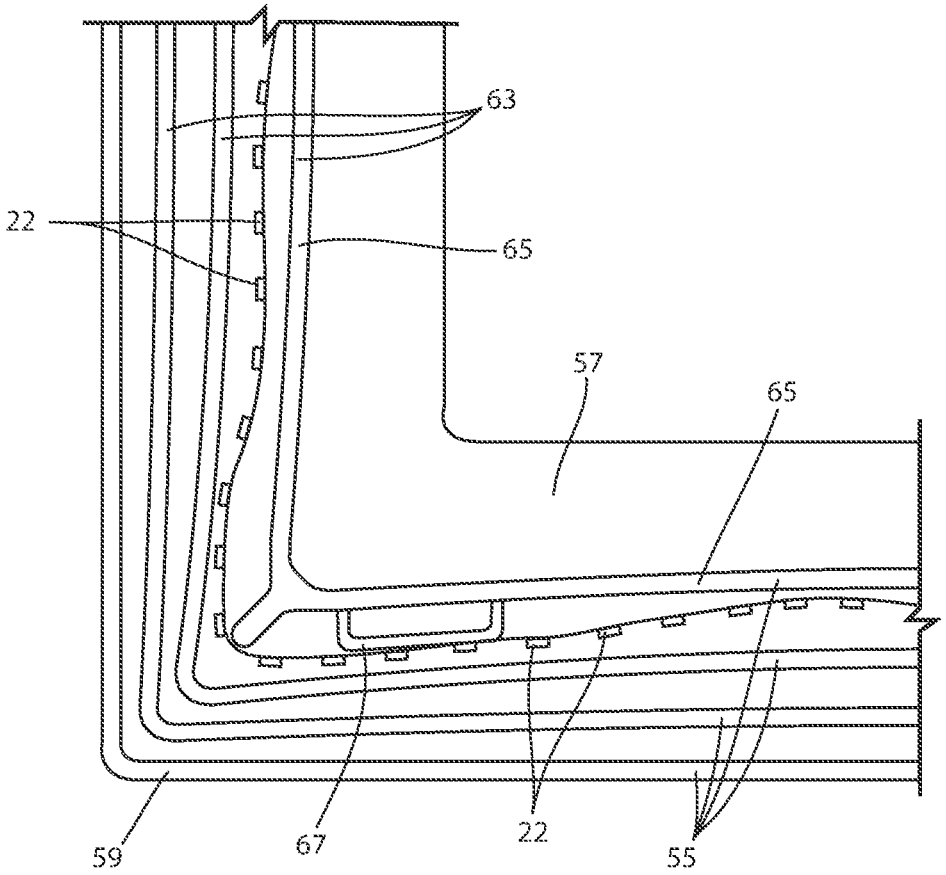
FIG. 9 is an enlarged partial view showing a corner section of the light-diffusing insert having a plurality of lighting elements positioned within the light-diffusing insert.

According to one embodiment, and as shown in FIG. 9, the light-diffusing insert 20 includes at least two spaced-apart upright walls 55 that are translucent. The light-diffusing insert 20 includes a base plate 57 and a plurality of spaced-apart walls 55 that extend perpendicularly upwardly from the base plate 57. The walls 55 include an outermost wall 59 and at least one inner wall 63, and the walls 55 are oriented parallel with one another. The lighting element 22 is positioned behind at least one of the inner walls 63 such that light passes from the lighting element 22 and through at least one of the translucent walls 55. Optionally, there are provided at least two inner walls 63. Furthermore, the innermost inner wall 65 can be used to help mount, or position the lighting element 22. In that regard, the lighting element 22 is positioned between two of the inner walls 63 (one of which is preferably the innermost inner wall 65).

In addition, there is also optionally provided at least one spacer 67 that is inserted between two of the walls 55 and is positioned adjacent the lighting element 22. The spacer 67 positions the lighting element 22 between the walls 55 so as to provide consistent illumination along the light-diffusing insert 20 by the lighting element 22. It has been determined that the intensity of the light that is visible through the light-diffusing insert 20 can vary based on the proximity of the lighting element 22 to the walls 55. When the lighting element 22 is provided in the form of a strip of LEDs which are positioned between the walls 55, then the spacer 67 can be used to adjust the position of a strip of LEDs so that consistent light is visible along the length of the light-diffusing insert 20.

Likewise, in order to provide a consistent amount of diffused lighting around any corners that the table 10 may have, the inner walls 63 deflect toward the outermost wall 59 near any corners 69 to ensure that the corners 69 receive a sufficient amount of lighting so as to maintain a consistent level of illumination about the side edge 19 of the table top 11.

The lighting elements 22 are mounted within the channel 18 so that, when turned ON they will illuminate the light diffusing insert 20 to provide a unique edge lighting for the table top 11. The lighting elements 22 may include integrated heat sink material for conducting heat out of the channel 18 or away from the lighting elements 22. Alternatively, the heat sink material may be separate from the lighting elements 22, and may include heat conductive metal plates or rods (not shown) that extend from the lighting elements to a bottom of the table top where such heat sinks are exposed to ambient air. In this manner, heat from the light sources within the table are conveyed to the surrounding air.

Figure 8:
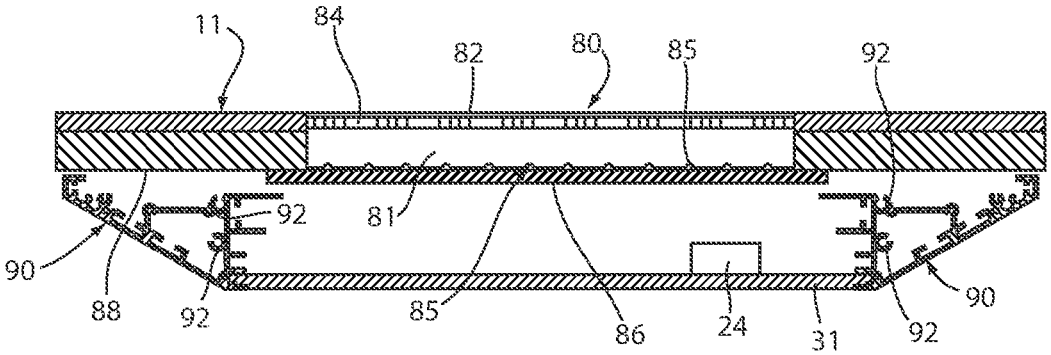
FIG. 8 is an enlarged cross sectional view of the display area taken along lines 8-8 of FIG. 7.

The table top edge lighting may be provided around the entire edge 19 of the table top 11 or only along sections thereof. In addition, the color of the lighting elements 22 may be changed or varied during use, and the intensity of the light may be varied or be dimmable when in use by using an appropriate controller 24. As shown in FIG. 8, the controller 24 may be mounted within a wire management panel 31 beneath the table top 11 and controllable remotely by RF signal or by appropriate switches (not shown) mounted along a side portion of the table 10.

The insert 20 may be recessed within the notched areas as shown in FIG. 4, or made flush with the side edge 19 of the table top 11. The lighting elements 22, which are preferably LEDs may be installed in strips or individually mounted.

The light-diffusing inserts 20 and the lighting elements 22 can be positioned at selective areas around the perimeter of the table top 11, or preferably, the light-diffusing inserts 20 and the lighting elements 22 can extend around the entire perimeter of the table top 11.

Figure 5:
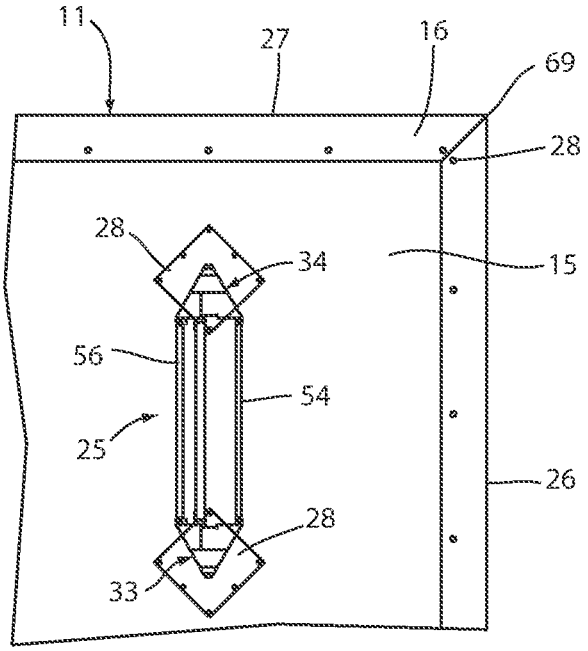
FIG. 5 is a partial bottom view of the lower top portion and an edge attachment and also showing a bottom view of one of the base supports for the table top.

With reference to FIG. 5, a section of a bottom corner of the table 10 of FIG. 1 is shown which includes a bottom view of one of the base supports 25 for supporting the table top 11. The lower edge portion 16 of the table top 11 is shown mounted along one end 26 and one side 27 of the table top 11 using fasteners such as screws or locking pins 28 that permit the lower edge portions 16 to be easily removed from the upper portion 14 of the table top 11 in order to allow separation of the upper portion 14 and the lower edge portion 16 of the table top 11 or to obtain access to the lighting and electrical wires that provide power to light sources used for the edge lighting. The lower edge portions 16 may be formed of the same material as the upper portion 14 of the table top 11 or a different material in order to provide a contrasting border to the edges 19 of the table top 11.

Figure 6:
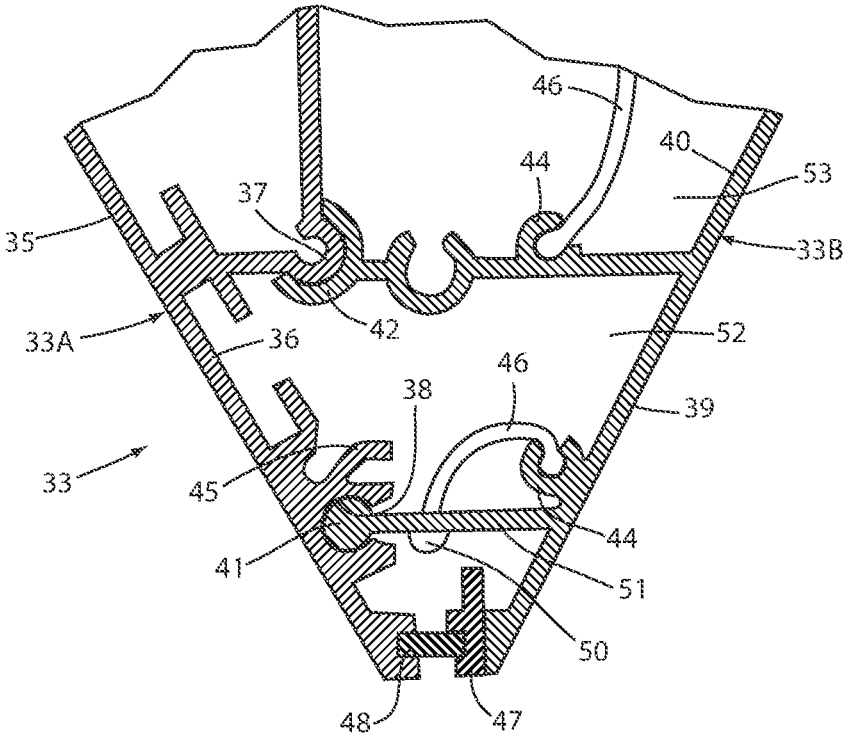
FIG. 6 is an enlarged partial cross sectional view of one of the base supports shown in FIG. 3.

Referring back to FIGS. 1 and 3, the conference table 10 includes a pair of base supports or pedestals 25 which are mounted to the lower surface 13 of the table top 11 by mounting plates 28. In the embodiment shown, only two base supports 25 are shown but it is envisioned that additional base supports 25 may be used, or that four or more conventionally-styled table legs may be used, provided that at least one or more of the base supports 25 or legs are constructed to permit wires or electrical connectors to be mounted therein or extended there through. As shown in FIG. 6, the base support 25 includes at least one open channel 53 extending the length of the base support 25 through which an electrical wire 46 extends upwardly to the table top 11. The electrical wire 46 is connected through the table top 11 to the lighting element 22 to provide electrical power to the lighting element 22.

It is also envisioned that a single base support 25, or pedestal could be used in accordance with the teachings of the invention. In addition, in preferred embodiments of the invention, the outer surface of the base supports 25 or legs include an opening (preferably a slotted opening) to accept a light-diffusing insert 48 in the base supports 25 or legs. The light-diffusing insert 48 is formed from a light diffusing material such as plastic or glass. As shown in FIGS. 1, 2, and 6, elongated vertically-extending light-diffusing inserts 48 have been mounted within vertically-extending channels formed in the outer and oppositely oriented sides or edges 33 and 34 of the base supports as will be described below.

With reference to FIG. 6, the opposite sides of an exemplary base support 25 may be formed as vertically extending "V"-shaped end pieces 33 and 34 such as by molding plastic material or forming metallic material. In the embodiment shown in FIG. 6, the end piece 33 includes two portions 33A and 33B that are assembled to one another by snap fitting. Base end piece portion 33A includes an outer finished and generally planar wall 35 and an inner wall 36 from which extends a first bulbous male-locking element 37, and a second spaced female-locking socket 38. Base end piece portion 33B also includes an outer generally planar wall 39 and an inner wall 40 from which extends a bulbous male-locking element 41 which frictionally seats within the locking socket 38 of the end piece portion 33A, and a spaced female-locking socket 42 which frictionally receives the male locking element 37 of the end piece portion 33A. The end piece portion 33B also includes "C"-shaped retention members 44 in which electrical wiring 46 can be frictionally retained. The end piece portion 33A also includes one or more similar "C"-shaped retention members 45.

When assembled, the end piece portions 33A and 33 B define a vertical open slot 47 in which a light diffusing insert 48 is mounted. The insert 48 may be formed from a plastic, such as an acrylic or polycarbonate, or a glass material. The insert 48 has an outer face viewable from the side of the base support 25. Optionally, the insert 48 can include one or more spaced-apart walls, similar to the light-diffusing insert 20. The insert 48 is illuminated by lighting elements 50, such as LED lights, which are connected to, and powered by, an electrical wire 46. The lighting elements 50 are mounted behind the light-diffusing insert 48 for illumination. The lighting elements 50 can be mounted directly to the back of the insert 48. Alternatively, the lighting elements 50 can be mounted to an inner flange 51 of the end piece portion 33B. The flange 51 extends vertically along generally the entire height of the base support 25 and the LEDs are mounted along a predetermined height of the flange. When powered, the LEDs back light the vertical insert 48 to provide a pleasing illuminated vertical edge for the base support 25. The same illumination structure is provided in the opposite side end piece 34.

Appropriate electrical wiring 46 is extended within a hollow or open channels 52 and 53 of end pieces 33 and 34 with the wiring be retained in place by the "C" shaped retention members 44 and 45. The wires 46 are connected to the LEDs mounted to the flange 41. It should be noted that light diffusing inserts 48 may be provided, not only in the opposite side edges of the end pieces 33 and 34 of the base supports, but optionally also in the front and rear walls 54 and 56, see FIG. 5, of each base support 25. Also, the light diffusing inserts 48 may be installed horizontally or in patterns within the front and rear walls, 54 and 56, of the base supports 25.

Electrical wiring for table top edge lighting is shown in FIG. 2. As shown, at least one wire-receiving channel or groove 60 is provided in an upper surface 61 of the lower portion 15 of the table top 11. The wire-receiving channel 60 extends from the top of the base support 25 to the lighting element 22, and the electrical wire extends through the wire-receiving channel 60. Although not shown, input wiring for the table 10 is supplied from a plug connected preferably to a floor mounted electrical socket so that one of the base supports 25 may be positioned over the electrical socket. The electrical wiring from the plug extends either to an ON/OFF switch (not shown) mounted to a bottom of the lower portion of the table top 11 or to the controller 24 having an ON/OFF switch also mounted to the lower portion of the table top. From either ON/OFF switch, electrical wires 46 extend through the open areas or channels 52 and 53 in the base supports 25 to provide power to the lighting elements within the base supports. Also, electrical wires 46 will extend upward through openings 73 in the lower portion 15 of the table top 11 and therefrom to the lighting elements 20 that provide the edge lighting for the table top 11. The openings 73 are aligned with the hollow area 52 or open channel 53 in each base support 25 so that no electrical wires are exposed but are enclosed within the components of the table. Alternatively, the openings 73 can extend into the wire management panel 31.

Figure 7:
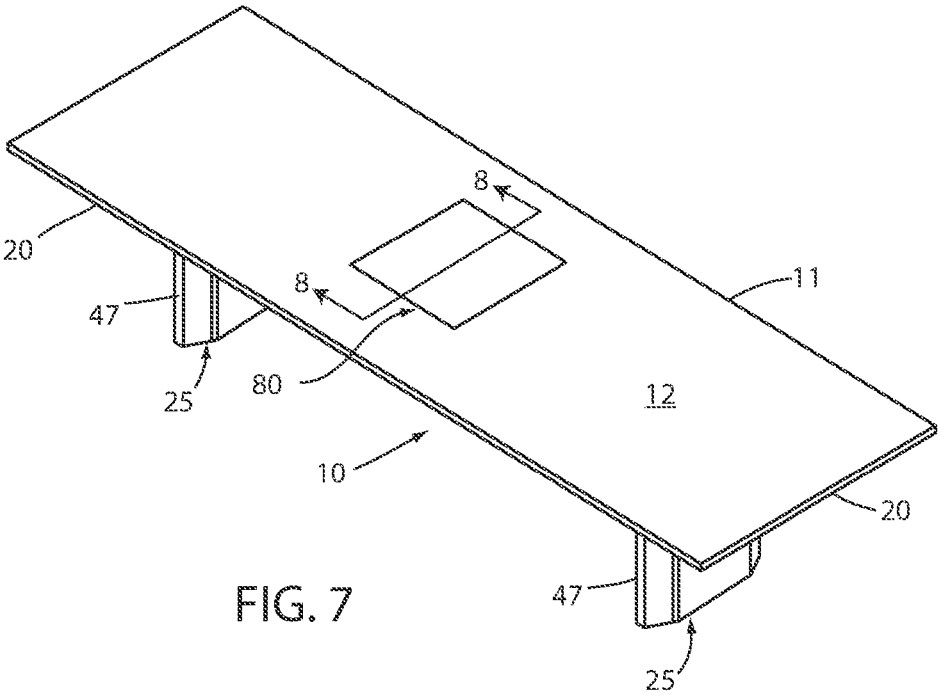
FIG. 7 is a top perspective view of another embodiment of the invention showing an illuminated display area formed centrally on a table top.

Another embodiment of the invention is shown in FIGS. 7 and 8, wherein a table top surface lighting feature 80 is shown which is mounted with the upper surface 12 of the table top 11. In this embodiment, an opening 81 is provided within the table top 11. The size and shape of the opening 81 may be varied. The lighting feature 80 also includes a cover 82 that may be transparent or translucent, and may be made from a plastic or glass material. In one embodiment, the cover 82 is a separate piece from the upper surface 12 of the table top 11, but is preferably flush with the upper surface 12. In another embodiment, the cover 82 sits atop the upper surface 12 and covers substantially the entire table top 11. In yet another embodiment, the upper surface 12 may be formed from a transparent or translucent material (preferably glass), and the upper surface 12 itself may form the cover 82. A table top lighting element 85 is housed within the opening 81 of the table top 11 and positioned under the cover 82 to provide backlighting illumination to at least a portion of the cover 82.

The lighting feature 80 may be used to display a company logo or other message, or to provide for backlighting for items placed over the cover 82. In the embodiment shown, a display 84, such as a logo panel, is mounted below the surface 82 and is illuminated using table top lighting elements 85, such as LED lights. The table top lighting elements 85 can be mounted on a backing panel 86 in the opening 81 that is removably mounted to a bottom surface 88 of the lower portion 15 of the table top 11. The display 84 can have selective portions that are either more or less transparent than other portions of the display 84 so that the display 84 can project, or illuminate, a particular image, icon, or other object through the cover 82. It is also envisioned that the display 84 can be controlled by, and manipulated by a computer, whereby the display 84 is capable of changing the transparency of particular locations (similar to a pixel) so that the display 84 can be changed at will by computer, or project a moving image. The backing panel 86 may optionally be formed of a heat conductive material so as to function as a heat sink to draw heat from the table top lighting elements 85 to the area beneath the top of the table 10.

Electrical wiring to the LED lights 85 extends through trim moldings 90 that are removably mounted to the lower portion 15 of the table top 11, as shown in FIG. 8, wherein the moldings 90 are shown in cross section. The moldings 90 include generally "C"-shaped wire retention members 92 similar to those used in the end pieces of the base supports described above, such that all wiring is hidden from view. FIG. 8 also shows a cross-sectional view of the wire management panel 31 which can house, and conceal, electrical components and wiring.

According to the invention described above, a table is provided which has integrated lighting and has a construction that conceals the necessary wiring and power components for the lighting.

What is claimed is:

1. A table having integrated lighting comprising:

a table top having an upper surface, a lower surface, and a side edge;

at least one side edge light-diffusing insert mounted along at least a portion of the side edge;

at least one lighting element mounted within the table top so as to illuminate the at least one side edge light-diffusing insert;

at least one base support mounted beneath the table top, the base support having at least one open channel extending the length thereof through which an electrical wire extends upwardly to the table top, the electrical wire being connected through the table top to the lighting element to provide electrical power to the lighting element; and at least one base support light-diffusing insert mounted in an outer surface of the base support, and at least one lighting element mounted within the base support behind the base support light-diffusing insert to illuminate the base support light-diffusing insert, and the electrical wire being connected to the lighting element in the base support to provide electrical power thereto.

2. The table of claim 1 wherein the lighting element includes a light-emitting diode.

3. The table of claim 1 wherein the side edge includes a horizontally-extending recessed channel, and the side edge light-diffusing insert and the lighting element are housed within the channel.

4. The table of claim 1 wherein the table top includes an upper portion and a lower portion, and the bottom portion includes at least one wire-receiving channel extending from a top of the base support to the lighting element, and the electrical wire extending through the wire-receiving channel.

5. The table of claim 1 including a lighting feature mounted with the upper surface of the table top, the lighting feature including a cover that is at least semi-transparent and allows at least some light to pass through, the lighting feature also including an additional table top lighting element that is housed within an opening of the table top and positioned under the cover to provide backlighting illumination to at least a portion of the cover.

6. The table of claim 5 including a display mounted between the table top lighting element and the cover, the display having selective portions that are more or less transparent than other portions so that a particular display can be illuminated through the cover.

7. The table of claim 1 wherein the side edge light diffusing inserts and the lighting elements extend around the entire perimeter of the table top.

8. The table of claim 1 wherein the lighting element is dimmable.

9. The table of claim 1 wherein the color of the lighting element can be selectively changed.

10. The table of claim 1 wherein the side edge light-diffusing insert is formed from a plastic material.

11. A table having integrated lighting comprising:

a table top having an upper surface, a lower surface, and a side edge;

at least one light-diffusing insert mounted along at least a portion of the side edge;

at least one lighting element mounted within the table top so as to illuminate the at least one light-diffusing insert; and wherein the light-diffusing insert includes at least two spaced-apart upright walls that are translucent, and the lighting element is positioned behind at least one of the walls such that light passes from the lighting element and through at least one of the translucent walls.

12. The table of claim 11 wherein the light-diffusing insert includes at least three spaced-apart upright walls that are translucent, and the lighting element is positioned behind at least two of the walls such that light passes from the lighting element and through the translucent walls.

13. The table of claim 11 wherein the table includes at least one corner, and the upright walls extend along the side edge parallel to one another except at the at least one corner in which any of the walls positioned inward of the outermost wall deflect toward the outermost wall so as to provide consistent illumination along the light-diffusing insert around the corner.

14. The table of claim 11 including at least one spacer that is inserted between two of the walls and is positioned adjacent the lighting element to position the lighting element between the walls so as to provide consistent illumination along the light-diffusing insert by the lighting element.

15. A table having integrated lighting comprising:

a table top having an upper surface, a lower surface, and a side edge;

at least one light-diffusing insert mounted along at least a portion of the side edge;

at least one lighting element mounted within the table top so as to illuminate the at least one light-diffusing insert; and wherein the light-diffusing insert includes a base plate and a plurality of spaced-apart walls that extend perpendicularly from the base plate, the walls defining an outermost wall and at least one inner wall, the outermost wall and the inner wall oriented parallel with one another except at any corner of the table top in which the inner walls deflects toward the outermost wall.

16. The table of claim 15 wherein the light-diffusing insert includes at least two inner walls.

17. The table of claim 16 wherein the lighting element is positioned between two of the inner walls.

18. The table of claim 15 including at least one spacer that is inserted between two of the walls and is positioned adjacent the lighting element to position the lighting element between the walls so as to provide consistent illumination along the light-diffusing insert by the lighting element.

* * * * *